US005624752A

United States Patent [19]

Hokudoh

[11] Patent Number: 5,624,752

[45] Date of Patent: Apr. 29, 1997

[54] SPUN YARN OF POLYBENZAZOLE FIBER

[75] Inventor: Toshiaki Hokudoh, Otsu, Japan

[73] Assignee: Toyo Boseki Kabushiki Kaisha, Osaka, Japan

[21] Appl. No.: 674,009

[22] Filed: Jul. 1, 1996

[30] Foreign Application Priority Data

Jul. 4, 1995 [JP] Japan ..... 7-168605

[51] Int. Cl.[6] ..... D02C 3/00

[52] U.S. Cl. ..... 428/357; 428/359; 428/364; 428/394; 528/377; 528/313; 528/321; 528/182; 57/243; 57/252; 57/255

[58] Field of Search ..... 428/357, 359, 428/364, 394; 528/377, 313, 321, 182, 183, 340, 322; 57/243, 252, 255

[56] References Cited

U.S. PATENT DOCUMENTS 5,527,609 6/1996 Yabuki et al. ..... 428/359

*Primary Examiner*—Newton Edwards
*Attorney, Agent, or Firm*—Foley & Lardner

[57] ABSTRACT

There is provided a spun yarn of a polybenzazole fiber having a single fiber fineness of 1 to 3 deniers and an average fiber length of 30 to 200 mm, the spun yarn having a tenacity of 15 g/d or higher and satisfying the following relationship:

$$10.0 \leqq K \cdot (L)^{1/3} \leqq 15.0 \quad (1)$$

where K is the twist constant expressed by $T/(Ne)^{1/2}$ and L is the average fiber length in millimeter, and where T is the number of twist per inch and Ne is the British cotton count of the spun yarn. The spun yarn can be used for various purposes because it has high tenacity, high heat resistance, high flame retardance, good feeling, and good appearance.

7 Claims, No Drawings

SPUN YARN OF POLYBENZAZOLE FIBER

FIELD OF THE INVENTION

The present invention relates to a spun yarn of a polybenzazole fiber, which has excellent characteristics such as high tenacity, high heat resistance, and good feeling.

BACKGROUND OF THE INVENTION

The conventional high-tenacity heat-resistant fibers such as para-polymerized aromatic polyamide fibers can only give a spun yarn with extremely low tenacity, and the original tenacity of these fibers is not fully utilized for the purpose of making a spun yarn with high tenacity and high heat resistance. As an attempt to make good use of fiber tenacity, there has been proposed a spun yarn having a single yarn fineness of 1 denier or less, preferably 0.8 denier or less, and also having a small number of fluffs, which is called "special spun yarn" (see, e.g., JP-A 4-361633/1992).

SUMMARY OF THE INVENTION

Under these circumstances, the present inventor has intensively studied to develop a spun yarn with high tenacity and high heat resistance, which are fully realized as compared with the conventional high-tenacity heat-resistant spun yarns, by making no use of special fine-denier fibers. As a result, he has found that the spinning of particular polybenzazole fibers under specific conditions makes it possible to attain this purpose, thereby completing the present invention.

Thus the present invention provides a spun yarn comprising a polybenzazole fiber having a single fiber fineness of 1 to 3 deniers and an average fiber length of 30 to 200 mm, the spun yarn having a tenacity of 15 g/d or higher and satisfying the following relationship:

$$10.0 \leqq K\cdot(L)^{1/3} \leqq 15.0 \quad (1)$$

where K is the twist constant expressed by $T/(Ne)^{1/2}$ and L is the average fiber length in millimeter, and where T is the number of twist per inch and Ne is the British cotton count of the spun yarn. It is preferred that the above spun yarn comprises polybenzazole fibers with a distribution of their length.

The spun yarn of the present invention has high tenacity, high heat resistance based on the decomposition temperature of polybenzazole fibers reaching 650° C., and high flame retardance, as well as good feeling and good appearance because of a good balance between the average fiber length and the number of twist. Moreover, cloths obtained from the spun yarn of the present invention have excellent cut resistance.

DETAILED DESCRIPTION OF THE INVENTION

The polybenzazole fiber used in the spun yarn of the present invention has a single fiber fineness of 1 to 3 deniers, preferably 1 to 2.5 deniers. If the fineness is smaller than 1 denier, many fluffs are formed on each strand of the spun yarn, which is responsible for poor workability in the textile treatment of the spun yarn and for poor appearance of a cloth obtained from the spun yarn. Moreover, the tenacity of the spun yarn is not satisfactory. If the fineness is greater than 3 deniers, the number of fibers contained in the spun yarn is decreased, which is responsible for a decrease in the tenacity of the spun yarn and for poor softness of a cloth obtained from the spun yarn. In addition, the flame contact resistance of the cloth based on the flame retardance and heat resistance of polybenzazole fibers is also decreased.

The polybenzazole fiber used in the spun yarn of the present invention has an average fiber length of 30 to 200 mm, preferably 50 to 200 mm. If the average fiber length is less than 30 mm, the tenacity of the spun yarn is decreased. If the average fiber length is greater than 200 mm, the spun yarn has deteriorated feeling, so that it can only be used for remarkably limited purposes. For example, the fluffs of the spun yarn cannot be effectively utilized for improving the adhesion to rubber or other materials to form a composite material. In view of these points, it is also useful to make a distribution of length in the polybenzazole fibers used in the spun yarn of the present invention.

As a process for obtaining such a spun yarn that comprises fibers with a distribution of their length, there is mentioned a process in which a tow of single fibers is stretch-broken into a sliver, which is then subjected to roving and spinning steps, resulting in a spun yarn. At this time, the fineness of single fibers ranging from 1 to 3 deniers is useful to facilitate the stretch-breaking of a tow, to attain the parallel orientation of single fibers in a sliver obtained, and to increase the uniformity on the sliver.

Such a spinning process of the stretch-breaking system is an preferred example of the process for obtaining the spun yarn of the present invention because it is useful to provide a spun yarn with high tenacity, as well as to attain the parallel orientation of single fibers and to increase the uniformity on the sliver.

In a conventional spinning process using a card, the fibers should be crimped to exhibit good properties in passing through the card. When such crimped fibers prepared from polybenzazole fibers used in the present invention are observed in detail, there can be found many lateral grooves, which are called "kinks". These kinks are directly responsible for a decrease in the tenacity of the fibers and hence a decrease in the tenacity of the spun yarn. Moreover, the fibers are deteriorated at the kink portions by exposure to sunlight, which also causes a decrease in the tenacity of the fibers and hence a decrease in the tenacity of the spun yarn.

The spinning process of the stretch-breaking system is a quite useful technique for obtaining a high-tenacity spun yarn comprising polybenzazole fibers because such a spun yarn can be obtained without imparting crimps to the fibers. Even in the case of the conventional spinning process using a card, the spun yarn of the present invention can also be obtained by employing the producing conditions that the fibers are damaged only to the lowest possible extent.

The term "fibers with a distribution of their length" as used herein refers to fibers with a constant distribution of their length, such as those obtained by the spinning process of the stretch-breaking system, except for fibers of constant length, which are obtained by the so-called constant length cutting.

The spun yarn of the present invention should satisfy the following relationship:

$$10.0 \leqq K\cdot(L)^{1/3} \leqq 15.0 \quad (1)$$

where K is the twist constant expressed by $T/(Ne)^{1/2}$ and L is the average fiber length in millimeter, and where T is the number of twist per inch and Ne is the British cotton count of the spun yarn.

The relationship (1) is essential to the spun yarn with high tenacity, good feeling, and good appearance. If the value of $K\cdot(L)^{1/3}$ is less than 10, the tenacity of the spun yarn is decreased. If the value of $K\cdot(L)^{1/3}$ is greater than 15, the tenacity of the spun yarn is also decreased with a decrease in the degree of utilization of fiber tenacity; moreover, when the spun yarn is formed into a cloth, the feeling of the cloth becomes rough and stiff. The value of $K\cdot(L)^{1/3}$ is preferably in the range of 11.0 to 14.0. The twist constant is preferably in the range of 2.5 to 4.0.

The spun yarn of the present invention can be used for textile products such as woven fabrics, in which case high-tenacity flame-retardant fabrics can be obtained and preferably applied to canvas, various working clothings, and the like. If the spun yarn of the present invention is used as warps or wefts of a woven fabric, or both, the tenacity of the woven fabric can readily be improved for the desired purposes.

Furthermore, in a certain application that requires no high tenacity but good passing properties in the subsequent step or a certain level of mechanical properties as a product, it becomes possible to attain the weight saving of cloths. The spun yarn of the present invention has an additional feature that it has excellent cut resistance, and it can be, therefore, preferably used for many purposes such as safety protectors utilizing this feature.

The term "polybenzazole fibers" as used herein refers to various fibers made of a polybenzazole (PBZ) polymer selected from the group consisting of polybenzoxazole (PBO) homopolymers, polybenzothiazole (PBT) homopolymers, and random, sequential or block copolymers of polybenzoxazole and polybenzothiazole. The polybenzoxazole, polybenzothiazole, and random, sequential or block copolymers thereof are disclosed in, for example, Wolfe et al., "Liquid Crystalline Polymer Compositions, Process and Products", U.S. Pat. No. 4,703,103 (Oct. 27, 1987), "Liquid Crystalline Polymer Compositions, Process and Products", U.S. Pat. No. 4,533,692 (Aug. 6, 1985), "Liquid Crystalline Poly-(2,6-Benzothiazole) Compositions, Process and Products", U.S. Pat. No. 4,533,724 (Aug. 6, 1985), "Liquid Crystalline Polymer Compositions, Process and Products", U.S. Pat. No. 4,533,693 (Aug. 6, 1985); Evers, "Thermooxidatively Stable Articulated p-Benzobisoxazole and p-Benzobisthiazole Polymers", U.S. Pat. No. 4,359,567 (Nov. 16, 1982); and Tsai et al., "Method for Making Heterocyclic Block Copolymer", U.S. Pat. No. 4,578,432 (Mar. 25, 1986).

The structural unit contained in the PBZ polymer is preferably selected from lyotropic liquid crystal polymers. Examples of the monomer unit for these polymers are depicted by the following structural formulas (a) to (h). It is preferred that the PBZ polymer is substantially composed of at least one monomer unit with a structure selected from these structural formulas (a) to (h), more preferably (a) to (c):

(a)

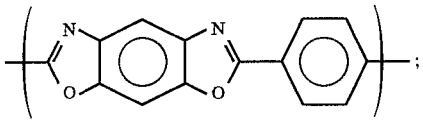

(b)

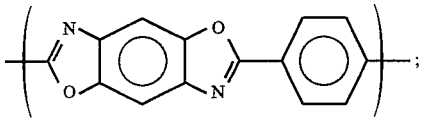

(c)

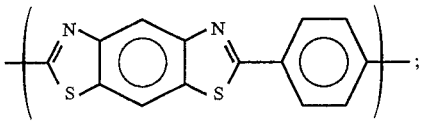

-continued (d)

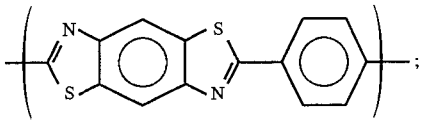

(e)

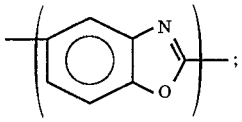

(f)

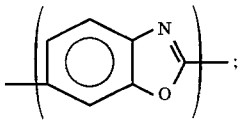

(g)

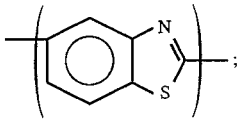

and (h)

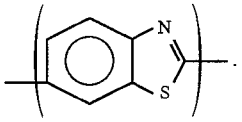

The present invention will be further illustrated by the following examples which are not to be construed to limit the scope thereof.

EXAMPLES 1–3 AND COMPARATIVE EXAMPLES 1–2

A spinning dope was prepared by dissolving cis-polybenzoxazole (PBO) with an intrinsic viscosity of 30 dl/g at a ratio of 14% by weight into polyphosphoric acid and extruded from a nozzle with 334 orifices each having a diameter of 0.22 mm at 160° C. at a discharge rate of 0.122 cc per orifice. The fiber-shaped dope thus extruded from the nozzle was allowed to pass through an air gap having a width of 22 cm, in which it was drawn. The fiber-shaped dope was allowed to pass though a coagulating bath adjusted to about 22° C. The coagulated fibers were successively washed with water on five or more pairs of rollers at a running speed of about 200 m/min, which were subsequently dried in advance without being rolled up, and then coated with a spinning oil, followed by rolling up. The resulting fibers had a single fiber tenacity of 42 g/d and a single fiber fineness of 1.5 deniers. These fibers were combined by doubling into a tow having a fineness of 30,000 deniers, which was crimped by an intrusion-type crimper and then cut by a rotary cutter into polybenzoxazole staples with different fiber lengths.

The PBO staples thus obtained were used to prepare a spun yarn of the British cotton count 20, from which a plain weave fabric was produced.

The physical properties of the spun yarn, together with the feeling of the plain weave fabric, are shown in Table 1. The spun yarns of Examples 1–3 exhibited good fabric productivity. In contrast, the spun yarns of Comparative Examples 1–2 caused an occurrence of kinky portions because of their high torque and hence had poor handling properties.

TABLE 1

| | Example 1 | Example 2 | Example 3 | Comp. Example 1 | Comp. Example 2 |
|---|---|---|---|---|---|
| Single fiber fineness (d) | 1.5 | 1.5 | 1.5 | 1.5 | 1.5 |
| Average fiber length (mm) | 44 | 76 | 132 | 44 | 76 |
| Twist constant | 3.4 | 2.6 | 2.4 | 4.6 | 4.0 |
| Value of $K \cdot (L)^{1/2}$ | 12.0 | 11.5 | 12.2 | 16.2 | 17.7 |
| Spun yarn tenacity (g/d) | 16 | 16 | 16 | 12 | 13 |
| Yarn evenness | good | good | fairly good | good | good |
| Fabric productivity | good | good | good | poor | poor |
| Fabric feeling | good | very good | very good | poor | poor |

The plain weave fabrics of Examples 1–3 had good or very good feeling, which was directly derived from the soft feeling of the PBO fibers. In contrast, the plain weave fabrics of Comparative Examples 1–2 had stiff feeling.

In general, the plain weave fabrics of Examples 1–3 had good mechanical properties, flame-proofness and good feeling as desired, because of high yarn tenacity. The flame-proofness was determined by the procedure defined in JIS L 1091, and it was found that the char length was 0 cm, which indicates very good flame-proofness.

EXAMPLES 4–5 AND COMPARATIVE EXAMPLES 3–7

A spinning dope was prepared by dissolving cis-polybenzoxazole (PBO) with an intrinsic viscosity of 30 dl/g at a ratio of 14% by weight into polyphosphoric acid and extruded from a nozzle with 334 orifices each having a diameter of 0.22 min. The fiber-shaped dope thus extruded from the nozzle was allowed to pass through an air gap having a width of 22 cm, in which it was drawn. The fiber-shaped dope was allowed to pass though a coagulating bath adjusted to about 22° C. The coagulated fibers were successively washed with water on five or more pairs of rollers at a running speed of about 200 m/min, which were subsequently dried in advance without being rolled up, and then coated with a spinning oil, followed by rolling up. The resulting fibers had a single fiber tenacity of 42 g/d and a single fiber fineness shown in Table 2. These fibers were combined by doubling into a tow having a fineness of 30,000 deniers, at which time the tow was immediately stretch-broken into fibers with an average fiber length shown in Table 2.

A sliver of these fibers was subjected to roving and spinning steps to prepare a spun yarn of the British cotton count 30, from which a plain weave fabric was produced.

The physical properties of the spun yarn, together with the feeling of the plain weave fabric, are shown in Table 2. In Examples 4–5, the spun yarns had good physical properties and the plain weave fabrics had good feeling. In Comparative Example 3, the spun yarn had poor physical properties, while the plain weave fabric had good feeling. In Comparative Examples 4–7, the spun yarns had poor physical properties and the plain weave fabrics had poor to very poor feeling.

TABLE 2

| | Example 4 | Example 5 | Comp. Example 3 | Comp. Example 4 | Comp. Example 5 | Comp. Example 6 | Comp. Example 7 |
|---|---|---|---|---|---|---|---|
| Single fiber fineness (d) | 1.5 | 1.5 | 1.5 | 1.5 | 1.5 | 1.5 | 5.0 |
| Average fiber length (mm) | 70 | 170 | 70 | 70 | 300 | 23 | 170 |
| Twist constant | 2.8 | 2.5 | 2.1 | 4.5 | 2.9 | 4.0 | 2.5 |
| Value of $K \cdot (L)^{1/2}$ | 11.5 | 13.8 | 8.7 | 18.5 | 19.4 | 11.4 | 13.8 |
| Spun yarn tenacity (g/d) | 17.0 | 16.8 | 11.7 | 12.5 | 16.0 | 7.2 | 11.0 |
| Yarn evenness | good | good | poor | fairly good | poor | rather poor | rather poor |
| Fabric productivity | good | good | poor | poor | poor | rather poor | poor |
| Fabric feeling | good | good | good | very poor | poor | poor | rather poor |

What is claimed is:

1. A spun yarn comprising a polybenzazole fiber having a single fiber fineness of 1 to 3 deniers and an average fiber length of 30 to 200 mm, said spun yarn having a tenacity of 15 g/d or higher and satisfying the following relationship:

$$10.0 \leqq K \cdot (L)^{1/3} \leqq 15.0 \quad (1)$$

wherein K is the twist constant expressed by $T/(Ne)^{1/2}$ and L is the average fiber length in millimeter, and where T is the number of twist per inch and Ne is the British cotton count of the spun yarn.

2. A spun yarn according to claim 1, wherein the spun yarn comprises polybenzazole fibers with a distribution of their length.

3. A spun yarn according to claim 1, wherein the polybenzazole fiber has a single fiber fineness of 1 to 2.5 deniers.

4. A spun yarn according to claim 1, wherein the polybenzazole fiber has an average fiber length of 50 to 200 mm.

5. A spun yarn according to claim 1, wherein the spun yarn satisfies the following relationship:

$$11.0 \leqq K \cdot (L)^{1/3} \leqq 14.0 \quad (2)$$

where K and L are as defined above.

6. A spun yarn according to claim 1, wherein the polybenzazole fiber is made of a polymer material selected from the group consisting of polybenzoxazole homopolymers, polybenzothiazole homopolymers, and copolymers of polybenzoxazole and polybenzothiazole.

7. A spun yarn according to claim 6, wherein the polymer material comprises a monomer unit selected from the group selected from the group consisting of:
(a)
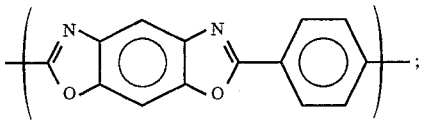
(b)
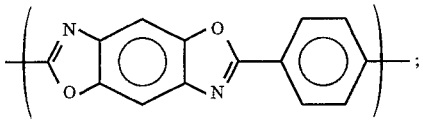
(c)
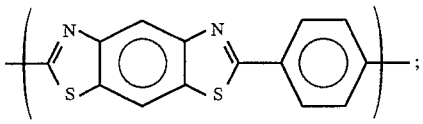
(d)
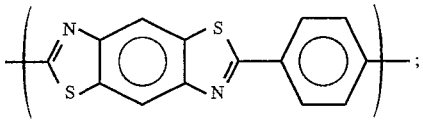
-continued
(e)
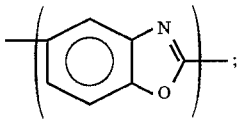
(f)
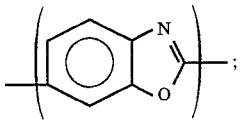
(g)
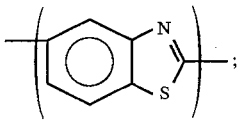
and
(h)
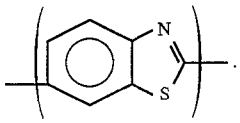
* * * * *